US005847508A

United States Patent [19]

Borowiec et al.

[11] Patent Number: 5,847,508

[45] Date of Patent: Dec. 8, 1998

[54] INTEGRATED STARTING AND RUNNING AMALGAM ASSEMBLY FOR AN ELECTRODELESS FLUORESCENT LAMP

[75] Inventors: Joseph Christopher Borowiec, Schenectady; John Paul Cocoma, Clifton Park; Victor David Roberts, Burnt Hills, all of N.Y.

[73] Assignee: General Electric Company, Schenectady, N.Y.

[21] Appl. No.: 316,989

[22] Filed: Oct. 3, 1994

[51] Int. Cl.[6] ..... H01J 17/24; H01J 17/26; H01J 17/20; H01J 17/16

[52] U.S. Cl. ..... 313/553; 313/564; 313/577; 313/634

[58] Field of Search ..... 313/161, 156, 313/490, 553, 573, 564, 577, 634

[56] References Cited

U.S. PATENT DOCUMENTS 4,262,231 4/1981 Anderson et al. .
4,410,829 10/1983 Anderson ..... 313/490
4,437,041 3/1984 Roberts .
4,622,495 11/1986 Smeelen .
5,213,537 5/1993 Roberts et al. .
5,412,288 5/1995 Borowiec ..... 313/490

*Primary Examiner*—Sandra L. O'Shea
*Assistant Examiner*—John Ning
*Attorney, Agent, or Firm*—Jill M. Breedlove; Marvin Snyder

[57] ABSTRACT

An integrated starting and running amalgam assembly for an electrodeless SEF fluorescent lamp includes a wire mesh amalgam support constructed to jointly optimize positions of a starting amalgam and a running amalgam in the lamp, thereby optimizing mercury vapor pressure in the lamp during both starting and steady-state operation in order to rapidly achieve and maintain high light output. The wire mesh amalgam support is constructed to support the starting amalgam toward one end thereof and the running amalgam toward the other end thereof, and the wire mesh is rolled for friction-fitting within the exhaust tube of the lamp. The positions of the starting and running amalgams on the wire mesh are jointly optimized such that high light output is achieved quickly and maintained, while avoiding any significant reduction in light output between starting and running operation.

6 Claims, 3 Drawing Sheets

INTEGRATED STARTING AND RUNNING AMALGAM ASSEMBLY FOR AN ELECTRODELESS FLUORESCENT LAMP

FIELD OF THE INVENTION

The present invention relates generally to electrodeless fluorescent lamps and, more particularly, to an amalgam assembly configured for optimally controlling mercury vapor pressure in such a lamp during starting and running thereof.

BACKGROUND OF THE INVENTION

The optimum mercury vapor pressure for production of 2537 Å radiation to excite a phosphor coating in a fluorescent lamp is approximately six millitorr, corresponding to a mercury reservoir temperature of approximately 40° C. Conventional tubular fluorescent lamps operate at a power density (typically measured as power input per external area) and in a fixture configuration to ensure operation of the lamp at or about a mercury vapor pressure of six millitorr (typically in a range from approximately four to seven millitorr); that is, the lamp and fixture are designed such that the coolest location, i.e., cold spot, in the fluorescent lamp is approximately 40° C. Compact fluorescent lamps, however, including electrodeless solenoidal electric field (SEF) fluorescent discharge lamps, operate at higher power densities with the cold spot temperature typically exceeding 50° C. As a result, the mercury vapor pressure is higher than the optimum four to seven millitorr range, and the luminous output of the lamp is decreased.

One approach to controlling the mercury vapor pressure in an SEF lamp is to use an alloy capable of absorbing/releasing mercury from/into its gaseous phase in varying amounts, depending upon temperature. Alloys capable of forming amalgams with mercury have been found to be particularly useful. The mercury vapor pressure of such an amalgam at a given temperature is lower than the mercury vapor pressure of pure liquid mercury.

Unfortunately, positioning an amalgam to achieve a mercury vapor pressure in the optimum range in an SEF lamp is difficult. For starting the lamp, i.e., initiating the discharge, the closer the amalgam is to the discharge, the faster the mercury is vaporized and higher light output is achieved quickly. However, for stable long-term operation, the amalgam should be placed and retained in a relatively cool location with minimal temperature variation.

Accordingly, it is desirable to position an amalgam in an electrodeless SEF fluorescent discharge lamp so as to achieve high light output quickly and to maintain such high light output during steady-state operation.

SUMMARY OF THE INVENTION

An integrated starting and running amalgam assembly for an electrodeless SEF fluorescent lamp comprises an amalgam support constructed to jointly optimize positions of a starting amalgam and a running amalgam in the lamp, thereby optimizing mercury vapor pressure in the lamp during both starting and steady-state operation in order to rapidly achieve and maintain high light output. In a preferred embodiment, the amalgam support comprises a wire mesh which is constructed to support the starting amalgam toward one end thereof and the running amalgam toward the other end thereof, and is rolled for friction-fitting within the exhaust tube of the lamp. The positions of the starting and running amalgams on the wire mesh are jointly optimized such that high light output is achieved quickly and maintained, while avoiding any significant reduction in light output between starting and running operation.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

Figure 1:
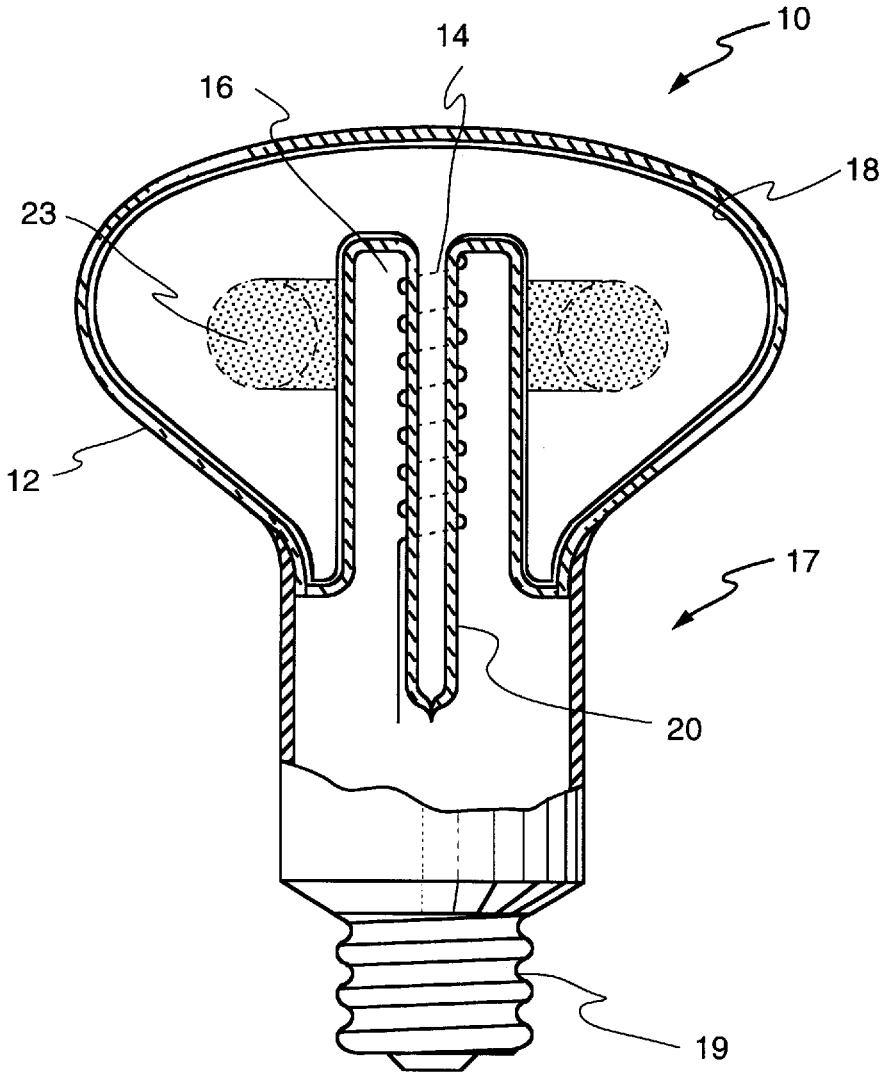
FIG. 1 illustrates, in partial cross section, a typical electrodeless SEF fluorescent lamp.

FIG. 1 illustrates a typical electrodeless SEF fluorescent discharge lamp 10 having an envelope, or bulb, 12 containing an ionizable gaseous fill. A suitable fill, for example, comprises a mixture of a rare gas (e.g., krypton and/or argon) and mercury vapor and/or cadmium vapor. An excitation coil 14 is situated within, and removable from, a re-entrant cavity 16 within bulb 12. For purposes of illustration, coil 14 is shown schematically as being wound about an exhaust tube 20 which is used for filling the lamp. However, the coil may be spaced apart from the exhaust tube and wound about a core of insulating material or magnetic material, e.g., a ferrite, or may be free standing, as desired. The interior surfaces of bulb 12 are coated in well-known manner with a suitable phosphor 18. Bulb 12 fits into one end of a base assembly 17 containing a radio frequency power supply (not shown) with a standard (e.g., Edison type) lamp base 19 at the other end.

In operation, current flows in coil 14 as a result of excitation by a radio frequency power supply (not shown). As a result, a radio frequency magnetic field is established, in turn creating an electric field within bulb 12 which ionizes and excites the gaseous fill contained therein, resulting in an ultraviolet-producing discharge 23. Phosphor 18 absorbs the ultraviolet radiation and emits visible radiation as a consequence thereof.

Figure 2:
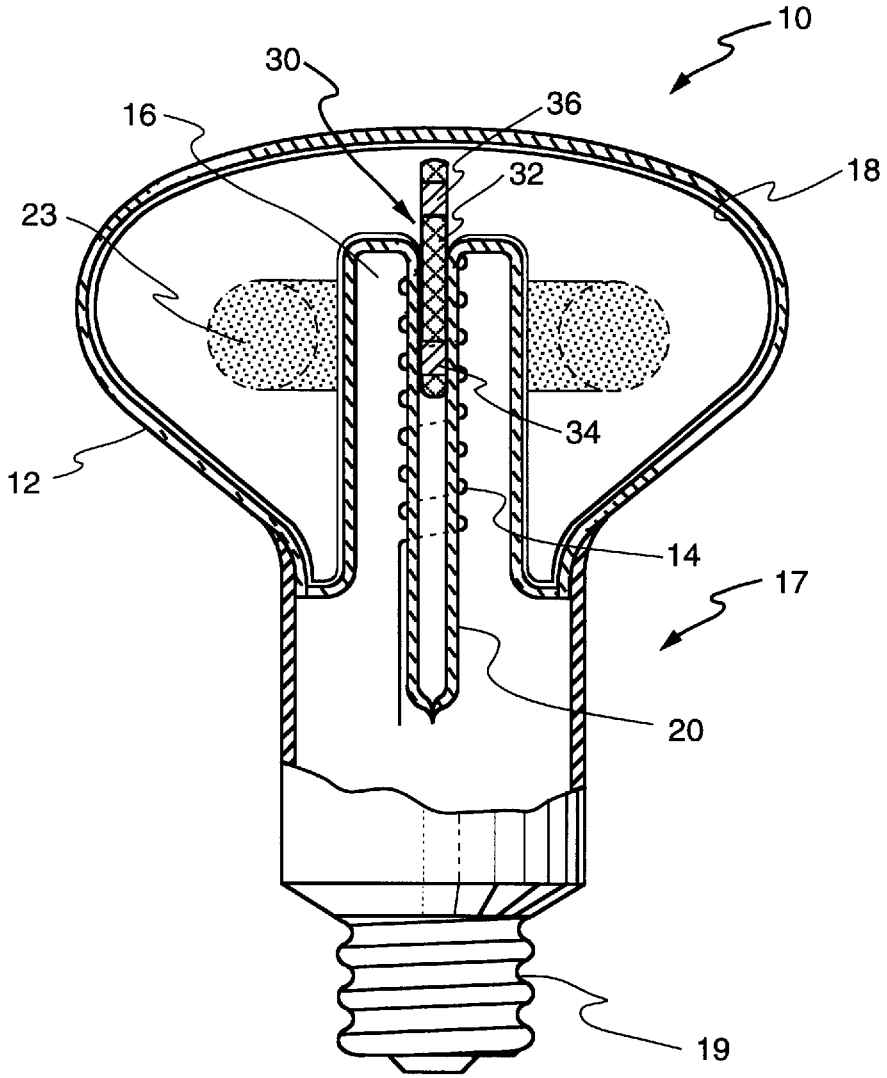
FIG. 2 illustrates an electrodeless SEF lamp including an integrated support for starting and running amalgams according to one embodiment of the present invention.

In accordance with the present invention, as illustrated in FIG. 2, an integrated starting and running amalgam assembly 30 comprising a friction-fitted metal member supports starting and running amalgams in optimal locations for starting and steady-state operation, respectively. The starting and running positions are jointly optimized to achieve high light output quickly and to maintain the high light output during steady-state operation, without any significant reduction in light output between starting and running conditions.

Figure 3:
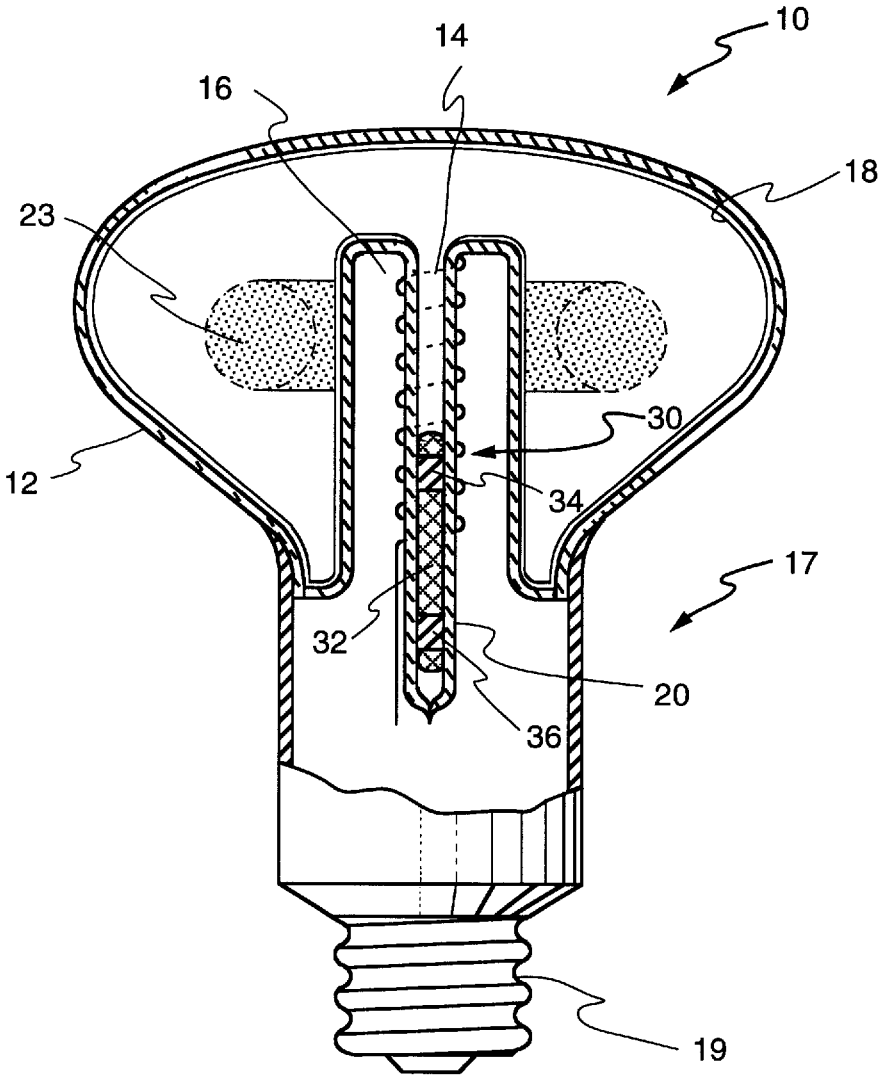
FIG. 3 illustrates an electrodeless SEF lamp including an integrated support for starting and running amalgams according to another embodiment of the present invention.

In one embodiment, as shown in FIG. 2, starting and running amalgam assembly 30 comprises a wire mesh 32 friction-fitted within exhaust tube 20 and supporting a starting amalgam 34 and a running amalgam 36 toward opposite ends thereof. Alternatively, the amalgam assembly 30 may comprise a strip of metal or a strip of metal having perforations therein. In the embodiment of FIG. 2, the starting amalgam 34 is positioned such that the portion of the coil 14 (or core, if used) which is surrounded by the discharge surrounds the amalgam 34. However, in other embodiments, such as that of FIG. 3, the starting amalgam 34 is positioned outside the portion of the coil surrounded by the discharge because, for such embodiments, the mercury of the starting amalgam would otherwise be released too fast, that is, before the running amalgam 36 can begin to control the mercury vapor pressure; as a result, the high light output which was achieved quickly would be reduced for a short period of time before the optimum steady-state vapor pressure were reached. Advantageously, jointly optimizing the locations of the starting and running amalgams on the integrated amalgam support assembly 30 avoids any undesirable reduction in light output between lamp starting and steady-state operation.

Wire mesh 32 may comprise, for example, stainless steel or nickel. Exemplary starting and running amalgams comprise a combination of bismuth and indium. Another exemplary amalgam comprises pure indium. Still another exemplary amalgam comprises a combination of lead, bismuth and tin, such as described in commonly assigned U.S. Pat. No. 4,262,231, cited hereinabove. And yet another amalgam may comprise a combination of zinc, indium and tin. Each amalgam has its own optimum range of operating temperatures.

During lamp processing, jointly optimized starting and running positions on amalgam support assembly 30 are each wetted with an alloy capable of forming an amalgam with mercury (e.g., indium). The position of the integrated starting and running amalgam assembly 30 determines the type of amalgam to be used as well as the locations of the running and starting amalgams on the wire mesh support 32. The amalgam support is rolled and friction-fitted within exhaust tube 20. Then, the exhaust tube is coupled to a pumping line, and the bulb is evacuated. A controlled amount of mercury is added to the lamp using a precise mercury dosing method to form the starting and running amalgams, the precise amount of mercury determining the performance of the starting and running amalgams. According to one mercury dosing method, mercury is added in solid form, for example as a mercury-zinc pellet such as of a type provided by APL Engineered Materials, Inc. When heated, the mercury liquefies and separates from the zinc to form the amalgam. According to another mercury dosing method, as described in U.S. Pat. No. 5,213,537 of V. D. Roberts et al., issued May 25, 1993, which is incorporated by reference herein, the lamp is dosed with mercury in the vapor phase. Finally, the bulb is filled through the pumping line and the exhaust tube, and the exhaust tube is sealed.

Advantageously, the integrated starting and running amalgam assembly does not interfere with lamp processing or require any modification of the re-entrant cavity.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A solenoidal electric field (SEF) fluorescent discharge lamp, comprising:

a light-transmissive bulb containing an ionizable, gaseous fill for sustaining an arc discharge when subjected to a radio frequency magnetic field and for emitting ultraviolet radiation as a result thereof, said bulb having an interior phosphor coating for emitting visible radiation when excited by said ultraviolet radiation, said bulb having a re-entrant cavity therein;

an excitation coil contained within said re-entrant cavity for providing said radio frequency magnetic field when excited by a radio frequency power supply;

an exhaust tube extending through said re-entrant cavity;

an integrated starting and running amalgam assembly comprising an amalgam support for supporting a starting amalgam and a running amalgam within said exhaust tube in optimized starting and running locations, respectively, to achieve and maintain a predetermined light output, while avoiding any substantial reduction therein between starting and running the lamp, said amalgam support comprising a metal member, said amalgam support being friction-fitted within said exhaust tube.

2. The lamp of claim 1 wherein said amalgam support comprises at least a partial cylinder.

3. The lamp of claim 1 wherein said amalgam support comprises a wire mesh.

4. The lamp of claim 3 wherein said wire mesh comprises a metal selected from a group consisting of nickel and steel.

5. The lamp of claim 1 wherein the optimized starting location is such that the starting amalgam is surrounded by the discharge during lamp operation.

6. The lamp of claim 1 wherein the optimized starting location is such that the starting amalgam is outside the portion of the exhaust tube surrounded by the discharge during lamp operation.

* * * * *